US011466377B2

(12) United States Patent
Hagen et al.

(10) Patent No.: US 11,466,377 B2
(45) Date of Patent: Oct. 11, 2022

(54) METHOD FOR PROVIDING A CATHODE LINING BARRIER LAYER IN AN ELECTROLYSIS CELL AND A MATERIAL FOR SAME

(71) Applicant: NORSK HYDRO ASA, Oslo (NO)

(72) Inventors: Eirik Hagen, Porsgrunn (NO); Espen Tjønneland Wefring, Vear (NO); Christian Schøning, Trondheim (NO)

(73) Assignee: NORSK HYDRO ASA, Oslo (NO)

( * ) Notice: Subject to any disclaimer, the term of this patent is extended or adjusted under 35 U.S.C. 154(b) by 0 days.

(21) Appl. No.: 17/264,368

(22) PCT Filed: Sep. 3, 2019

(86) PCT No.: PCT/EP2019/073452
§ 371 (c)(1),
(2) Date: Jan. 29, 2021

(87) PCT Pub. No.: WO2020/048972
PCT Pub. Date: Mar. 12, 2020

(65) Prior Publication Data

US 2021/0310139 A1 Oct. 7, 2021

(30) Foreign Application Priority Data

Sep. 4, 2018 (NO) ..... 20181153

(51) Int. Cl.
*C25C 3/06* (2006.01)
*C25C 3/08* (2006.01)

(52) U.S. Cl.
CPC ..... *C25C 3/085* (2013.01)

(58) Field of Classification Search
CPC .. C25C 3/08; C25C 3/085; C25C 3/06; C25C 7/005; C25C 7/025; C25C 3/00
See application file for complete search history.

(56) References Cited

U.S. PATENT DOCUMENTS

| | | | |
|---|---|---|---|
| 4,591,419 | A | 5/1986 | Moeller et al. |
| 4,737,254 | A | 4/1988 | Gesing et al. |
| 5,744,413 | A | 4/1998 | Cortellini |
| 2017/0321337 | A1 | 11/2017 | Proshkin et al. |

FOREIGN PATENT DOCUMENTS

| | | |
|---|---|---|
| DE | 11 2009 002 443 | 10/2012 |
| EP | 0 399 786 | 11/1990 |
| RU | 2 131487 | 6/1999 |
| RU | 2 276 700 | 5/2006 |
| SU | 918335 | 4/1982 |
| WO | 83/03106 | 9/1983 |
| WO | 2010/044078 | 4/2010 |

OTHER PUBLICATIONS

International search Report dated Dec. 5, 2019, in International (PCT) Application No. PCT/EP2019/073452.
Written Opinion of the International Searching Authority dated Dec. 5, 2019, in International (PCT) Application No. PCT/EP2019/073452.

*Primary Examiner* — Zulmariam Mendez
(74) *Attorney, Agent, or Firm* — Wenderoth, Lind & Ponack, L.L.P.

(57) ABSTRACT

The present invention relates to a method and a material for establishing a cathode barrier layer in electrolysis cells for production of aluminum of Hall-Heroult type, the barrier layer can comprise minerals combined with a compound that lowers the melting temperature of the minerals, such as fluorides.

14 Claims, 2 Drawing Sheets

Figure 1:
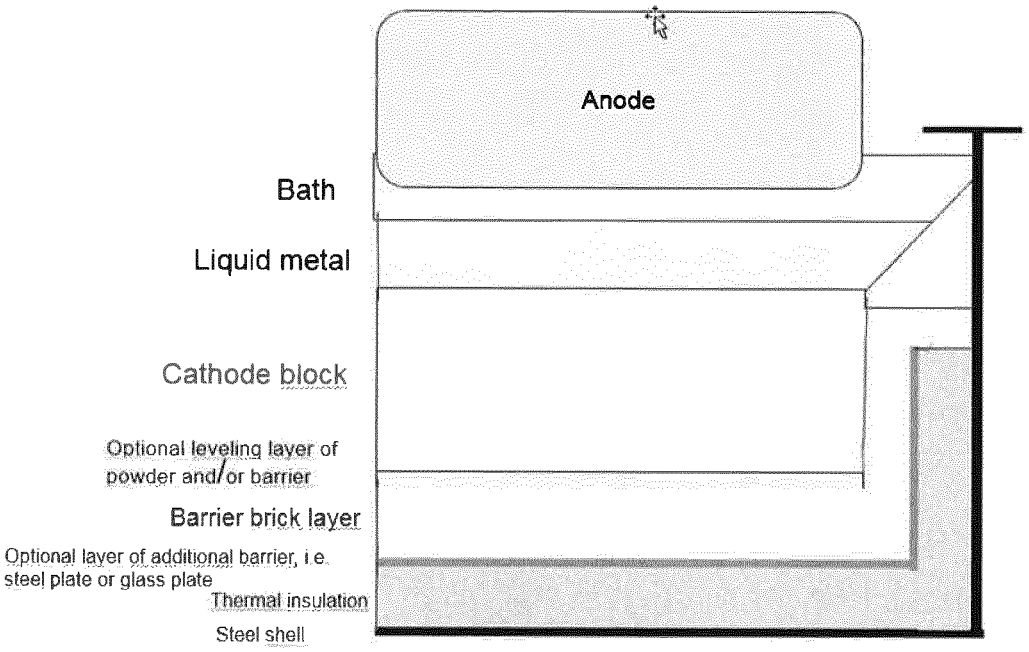

METHOD FOR PROVIDING A CATHODE LINING BARRIER LAYER IN AN ELECTROLYSIS CELL AND A MATERIAL FOR SAME

The present invention relates to a method for providing a cathode barrier layer in electrolysis cells for production of aluminium, and a material for same. The cells can e.g. be of Hall-Héroult type with prebaked anodes or Søderberg anodes.

The Hall-Héroult process, named after its inventors, is the most used method by which aluminium is produced industrially today. Liquid aluminium is produced by the electrolytic reduction of alumina ($Al_2O_3$) dissolved in an electrolyte, referred to as bath, which mainly consists of cryolite ($Na_3AlF_6$).

In the state of the art alumina reduction cell with prebaked anodes, hereafter referred to as the cell, several prebaked carbon anodes are dipped into the bath. The alumina is consumed electrochemically at the anode.

As can be seen from Equation (1), the carbon anode is consumed during the process (theoretically 333 kg C/t Al).

$$\frac{1}{2}Al_2O_3 + 3NaF + \frac{3}{4}C \rightarrow AlF_3 + \frac{3}{4}CO_2 + 3Na^+ + 3e \quad (1)$$

The lower part of the cell, the cathode, consists of a steel shell typically lined with carbon cathode, refractory and thermal insulation. A pool of liquid aluminium is formed on top of the carbon floor. The cathode, in the electrochemical sense, is the interface between the liquid aluminium and the bath, described by $$AlF_3 + 3Na^+ + 3e \rightarrow Al + 3NaF \quad (2)$$

and the total cell reaction becomes $$\frac{1}{2}Al_2O_3 + \frac{3}{4}C \rightarrow Al + \frac{3}{4}CO_2 \quad (3)$$

Pure cryolite ($Na_3AlF_6$) has a melting point of 1011° C. To lower the melting point of bath which contains $Na_3AlF_6$, the liquidus temperature, aluminum fluoride ($A/F_3$) and calcium fluoride ($CaF_2$), to mention the most important ones, are added to the bath. The bath composition in a cell may typically have 6-13 [wt %] $A/F_3$, 4-6 [wt %] $CaF_2$, and 2-4 [wt %] $Al_2O_3$ in addition to $Na_3AlF_6$. Lowering the liquidus temperature makes it possible to operate the cell at a lower bath temperature, but at the expense of reduced solubility of $Al_2O_3$ in the bath, demanding good $Al_2O_3$ control.

The bath temperature during normal cell operation is between (but not limited to) 940° C. and 970° C. The bath is not consumed during the electrolytic process, but some is lost, mainly due to vaporization. The vapor mainly consists of $NaAlF_4$. In addition, some bath is lost by entrainment of small droplets, and water present in the alumina feed reacts to form HF. Bath components also penetrate down through the cathode. In principle, the current invention does not require a specific bath temperature other than sufficiently high for the bath in use to be liquid.

At the sidewalls of the cathode there is commonly a frozen layer of bath, called side ledge, which protects the carbon sidewall from erosion. The thickness of the side ledge is a function of the heat flow through the sides, which is a function of the difference in bath temperature and liquidus temperature.

The benefits of the presented invention are linked to protection of the cell insulation. Today the cell lining typically comprises of a barrier brick (e.g. based on chamotte, see FIG. 1) in combination with other materials/components. The barrier bricks are placed below the cathode block and is in some cases combined with other types of barrier such as for example steel plates or glass. The function of this barrier layer is for example to protect the thermal insulation placed below the refractory bricks and above/towards the steel shell from being attacked by bath components that penetrate down through the cathode blocks, cracks in the lining or other. The barrier brick will slowly react with the bath components and over time be consumed/converted. The speed of this consumption/reaction will depend on the thermal balance in the reduction cell. The reaction between the bath components and for example a chamotte barrier brick will over time produce a glassy layer in the form of a viscous liquid. Over time this layer will be immiscible with the bath components that penetrate the cathode blocks. The viscous liquid will act as a barrier towards further reaction/degradation of the barrier brick and gas penetration into the cathode lining.

The above-mentioned reaction between bath and the barrier brick results in a volume expansion as the product volume is larger than the reactant volume. This may lead to heaving of the cathode blocks and potentially a crack along the center line of the cathode panel.

Figure 2:
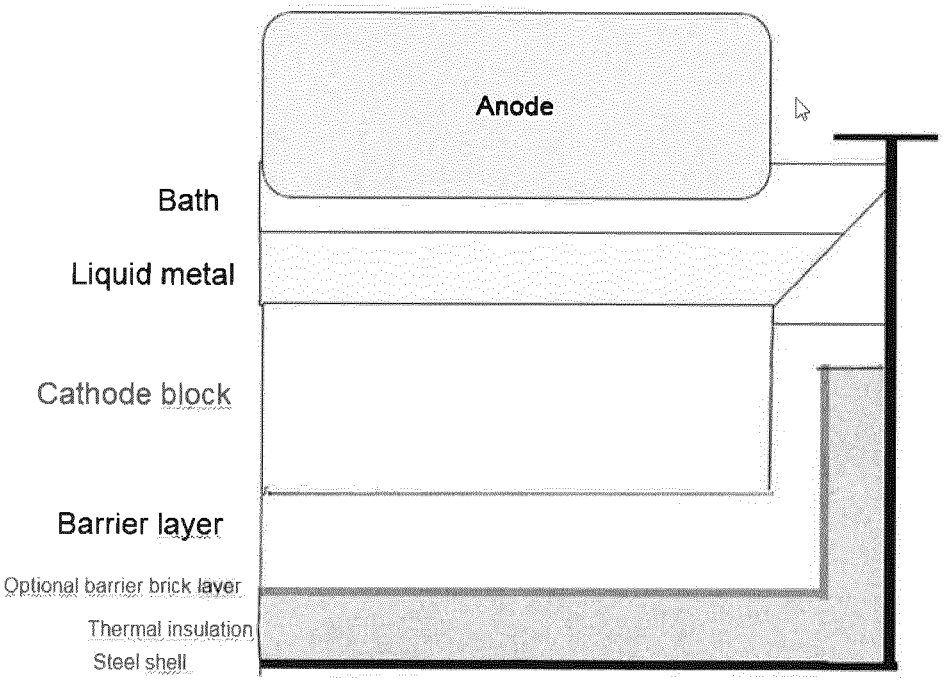

The invention presented here shows how a barrier can be created at an earlier stage which limits/removes the need for using conventional barrier bricks. The invention produces the viscous liquid barrier layer, normally observed over time in a conventional cell, during cell start-up and will act to protect the back-up insulation before bath addition during cell start-up. The cell lining can then be limited to a relatively thin layer of the new barrier above the thermal insulation (FIG. 2). This will allow for e.g. taller cathode blocks, more thermal insulation, and/or increased cell cavity.

One important feature of the material forming the layer in an early stage is that the melting temperature of the mixture is adjusted by addition of one or more components that reduces the melting temperature of the material, enabling forming a viscous liquid in the start-up phase of the cell.

The new barrier is based on Na—Al—Si—O minerals such as high alkali feldspars or nepheline syenites (hereafter collectively denoted "minerals") in combination with fluorides and SiO2. The minerals can be installed with the addition of 0.1-30 wt % fluorides in the form of Na3AlF6 or its equivalent in electrolysis bath/NaF/AlF3 or spent pot lining. SiO2 can be used to adjust the viscosity of the mixture to the desired point. The invention makes it possible to re-use spent pot lining materials, typically denoted $2^{nd}$ cut, comprising non-carbon based lining materials. For instance, $2^{nd}$ cut spent pot lining containing fluoride components may be crushed down to a powder material and used as a fluoride source in the barrier layer when lining a new cell.

Importantly the barrier will form in the mineral layer below the cathode blocks and bath components will not be able to attack conventional barrier bricks or insulation bricks that is placed below the mineral layer.

The barrier can be installed either as a powder or as pre-shaped bricks, or a combination of powder and pre-shaped bricks. The density of the viscous liquid barrier once in operation should be higher than that of the bath coming through the cathode blocks and aluminum. The barrier material can also be installed as a slurry, e.g. with water as the liquid.

It will be beneficial that the mixture of minerals and the melting temperature reducing compound(s) is a homogenous mixture to enable a rapid transformation of solid material to a highly viscous liquid that effectively hinders penetration of bath components hazardous for the underlying lining.

The barrier will during start-up or in a very early part of the cell's life become a layer where two immiscible liquids act as a barrier towards further penetration of both bath components and gasses/fumes in the lining. The barrier has very low reactivity towards conventional high silica alumina-silicate lining materials.

WO83/03106 relates to diffusion barrier for electrolysis furnaces for the preparation of aluminium. The diffusion barrier comprises a material which react with sodium fluoride to form compounds which are solid at the temperature in question.

EP 0399786A2 discloses refractory linings for use in aluminium reduction cells. A refractory liner is placed below a carbon cathode and comprises three layers of solid refractories based on aluminosilicate materials.

DE 11 2009 002 443 T5 discloses a refractory material for protection of pipes comprising aluminosilicates and sodium silicates, where a preferred aluminosilicate is nepheline syenite.

RU 2131487 C1 discloses a protective layer for use in aluminium production, where an upper protective layer that consists of powdered mixture of alumina and aluminium fluoride or cryolite is placed beneath carbon cathode blocks.

SU 918335 discloses a protective lining for an aluminium electrolysis cell, made of the mineral nepheline. The protective layer can be installed as plates or as a powder.

In U.S. Pat. No. 5,744,413, nepheline and feldspar are used (1-10 wt %) in a mixture with alumina-silica refractory grains (75-95 wt %) and an inorganic cementitious binder.

US2017/0321337A1 relates to lining of the cathode of an electrolytic cell. It is mentioned that if there is an excess of refractory material and small amount of NaF, nepheline reacts with silicon dioxide to form albite that will be in a glassy viscous molten state to prevent further movement of the interaction front down to the lower part of the cathode in the cell. The formation of albite is based upon penetration of bath components into excess conventional refractory material during operation of the cell. This is different to the current invention as the current invention is based on a mixture of minerals and compound(s) that effectively lowers the melting temperature of the mineral(s) to form a barrier in early cell-life before bath penetrates the cathode and attacks the lining materials below the cathode.

In the case where the minerals are installed without mixing in component(s) that lowers the melting temperature of the minerals, during cell lining, the cathode barrier layer in the form of a viscous liquid will not form before bath starts to penetrate the cathode block. After bath addition to the cell and a sufficiently high temperature is obtained during cell start-up, bath normally starts to penetrate the cathode. The fluorides in the penetrating bath will start reacting with the barrier minerals installed during cell lining similar to the reaction observed with conventional barrier bricks. A functional barrier will not be obtained prior to bath addition during cell start-up with the method described in this paragraph and the method is hence inferior to the invention. The bath penetration through the cathode block will again be influenced by the cathode block temperature, porosity, bath chemistry and else. By using this method it is also more unpredictable how, when and where the barrier layer forms, and the composition and thickness of it. A further consequence of not having melting temperature reducing components in the mix during lining is that the invented barrier will not protect versus penetrating liquids through cracks in the early life of the cell/during start up.

According to the invention it is achieved to a method for providing a cathode lining barrier layer in a Hall-Héroult electrolysis cell for production of aluminum, where the cell comprises an electrolytic bath having components of NaF, $AlF_3$, and $Na_3AlF_6$ in addition to other components, and that the cathode lining comprises a cathode panel of cathode blocks supported by at least one layer of a refractory material wherein, —during lining of the cell, a mixed material that comprises a mixture of mineral(s) and a chemical compound(s) that effectively lowers the melting temperature of the said mineral(s) is arranged between the said at least one layer of refractory material and the said cathode blocks, where during start-up of said cell and as a certain temperature is achieved in the mixed material, the mixed material forms a viscous liquid, where the viscous liquid has high viscosity, and a density higher than that of the bath components eligible to penetrate the cathode blocks—and forms a barrier that is effectively immiscible with the penetrating bath components.

By the present invention the following advantages can be achieved;

For instance, less refractory in the lining gives possibilities for larger cavity/more flexibility for designing the cell.

For instance, designing the cell with taller cathode blocks that can result in longer life span of the cell and increase earnings.

The invention enables early establishment of barrier with pre-designed properties. As a result, it can be in place and operable before bath penetration starts.

This early stage formation of barrier gives safer start-up, and in particular if cracks/openings are present in the lining/ramming paste.

The invention also prevents/limits reaction between bath components and conventional barrier bricks, which normally would lead to a volume expansion and heaving of the cathode panel, and potentially result in a crack along the center line of the cathode panel which may be detrimental for cell life. This further allows more flexibility with respect to the mechanical properties of the cathode blocks.

The abovementioned advantages and further advantages can be obtained by the invention as defined in the accompanying claims.

The invention shall be further described by examples and figures where:

FIG. 1 discloses a sketch of the typical cross section of a prior art reduction cell showing thermal insulation, typical layers of barrier bricks and/or steel/glass plates and optional levelling powder below the cathode block, FIG. 2 discloses in more detail how a barrier layer according to the present invention can be arranged beneath a cathode block above the thermal insulation, FIG. 3 discloses two immiscible phases with the barrier layer at the bottom in a solid piece of albite and nepheline based brick, FIG. 4 discloses a cup-test with a conventional chamotte barrier brick.

DESCRIPTION

FIG. 1 discloses a sketch of the typical cross section of a prior art reduction cell showing the thermal insulation, typical layers of barrier bricks and/or steel/glass plates and levelling powder below the cathode block. The main parts from top to bottom are: anode, bath, liquid metal, cathode block, optional levelling layer of powder and/or barrier, barrier brick layer, optional layer of additional barrier e.g. steel plate or glass plate, thermal insulation and steel shell.

FIG. 2 discloses in more detail how a barrier layer can be arranged beneath a cathode block above the thermal insulation, according to the present invention. The main components from top to bottom are: Anode, bath, liquid metal, cathode block, barrier layer mixed material as powder, brick or a combination of both powder and brick, or possibly a slurry, alternatively re-used material, optional barrier brick layer, thermal insulation and steel shell.

The mixed material (minerals and compound(s) that lowers the melting temperature of the minerals, such as fluorides) that results in the above-mentioned cathode barrier layer should be installed during lining of the cell. Typically, the thermal insulation in the lining will be installed in the steel shell. The barrier layer mixed material should be installed directly on top of the thermal insulation bricks. The barrier layer mixed material is installed as a dry powder, as pre-shaped bricks (fired or non-fired) or as a slurry. If pre-shaped bricks are used, a layer of dry powder or slurry with the barrier mixed material can be used for leveling purposes before installing the carbon cathode blocks. If the barrier layer mixed material is installed as a powder or slurry an optional compaction step is possible using a vibrating plate compactor or similar before the carbon cathode blocks are installed.

In one embodiment of the invention, the grain size distribution of the minerals can be 1-2.8 mm (24%), 0.25-1 mm (15%), 0.25-0.5 mm (15%), 0.125-0.25 mm (16%), 0.063-0.125 mm (16%), <0.063 mm (14%). However, the grain size distribution can be adjusted to adapt to economical and practical considerations during installation and utilization of the current invention.

After the barrier layer mixed material is installed, the rest of the cathode is lined and the cell is prepared for conventional pre-heating. No active action is required with respect to the barrier layer mixed material after the lining is finished.

During pre-heating of the cell, the center of the cathode surface will show a higher temperature than the cathode edges. Liquid electrolysis bath will be added to the cell when the temperature of the cathode center and the near surroundings are sufficiently high. The electrolysis bath has a freezing temperature relatively close to the normal operating temperature of the cell and it is not uncommon that the added bath freezes on the cathode surface, at least towards the edges of the cathode surface. This frozen bath will melt gradually as the temperature of the cell homogenizes during the first hours after bath addition.

In the case where a mixed material comprising minerals together with the melting point lowering compounds, such as fluoride, are installed during lining of the cell, a viscous liquid will form during pre-heating of the cell. The barrier functionality with a viscous liquid will have formed when the cell reaches operating temperature. A full barrier functionality will hence have been obtained before bath starts penetrating through the cathode after bath addition.

It is not crucial that the viscous liquid forms under the whole cathode at the same time because bath penetration will be prohibited by low cathode temperatures during bath addition in locations where the viscous liquid has not yet formed due to low temperature.

The viscous liquid formed under the cathode by the barrier layer material mixture is not miscible with the bath penetrating the cathode after bath addition to the cell and the protective nature of the barrier layer is hence assured.

According to the present invention, it is noted that no action is required after the cell lining is finished. The cell start-up can proceed as normal with pre-heating times of e.g. 48-72 hours. The viscosity of the viscous liquid cathode barrier layer can be predefined before being installed in a cell by adjusting the mineral's melting temperature by adding the chemical compounds for that, such as fluoride and also with addition of $SiO_2$.

The source of fluoride in this context can be, but is not limited to, cryolite, electrolytic bath, NaF, AlF and spent pot lining with fluoride content, either as single fluoride sources or a combination of the above mentioned.

On top of the thermal insulation and below the invented barrier layer it is possible, but not required for the functionality of the barrier, to install additional conventional barrier bricks (for example based on chamotte).

The compositional window for the cathode barrier layer is 0.1-30 wt % cryolite (or its fluoride equivalent if other fluorine sources are used) mixed with 99.9-70 wt % minerals. The resulting cathode barrier layer should have a density higher than the bath components penetrating the cathode. The bath penetrating the cathode is typically enriched with NaF relative to the bath where the aluminium reduction occurs.

Figure 3:
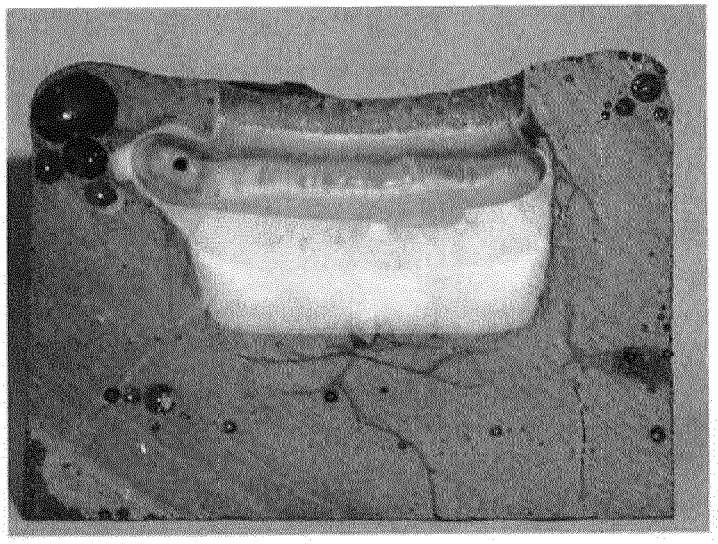

FIG. 3 discloses two immiscible phases with the barrier layer at the bottom in a solid piece of albite and nepheline based brick, the brick was heated to 950° C. and kept at 950° C. for 24 hours. The fluoride melt consists of 60 wt % cryolite and 40 wt % NaF. The top left bulge is due to porosity and not reaction between the brick and the melt. The white lower part is the viscous liquid phase and the upper grey part is the fluoride.

Figure 4:
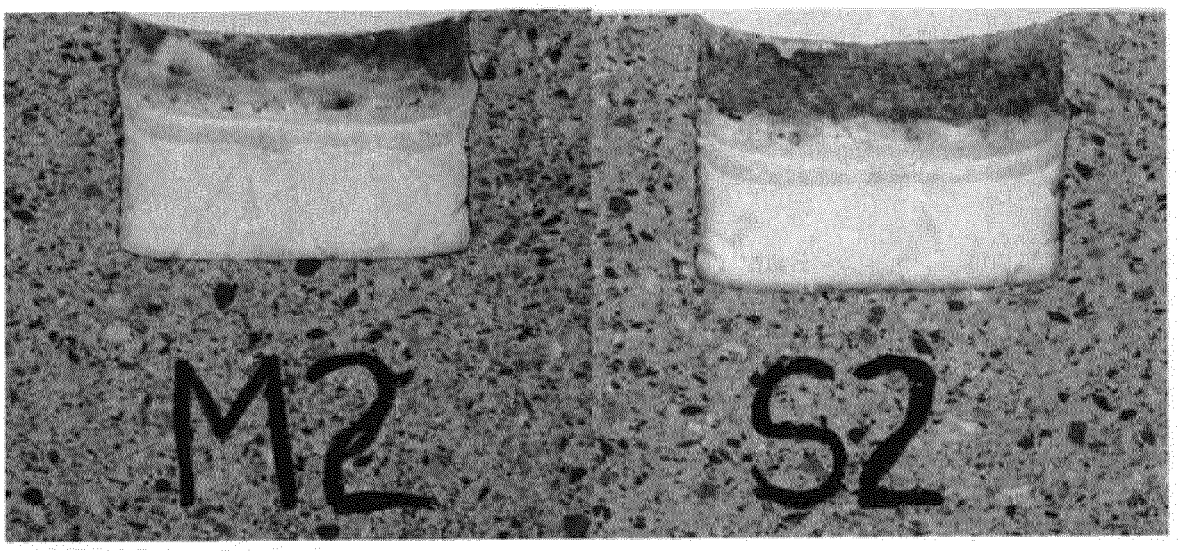

FIG. 4 discloses a cup-test with a conventional chamotte barrier brick. The pictures of the species M2 and S2 show the low reactivity of the barrier mixed material in the bottom of the cups (white) based on sodium feldspar (left, Sibelco Germany) and nepheline syenite (right, Sibelco Canada). The fluoride melt is floating at the top. The cups were heated to 950° C. and kept at this temperature for 24 hours. The barrier material mixture contains 85 wt % feldspar or nepheline together with 15 wt % cryolite.

The tests clearly show the capability of the viscous barrier to hinder the fluoride to pass it.

In one embodiment, the barrier material comprises a powder mix of fluoride and feldspar applied as a layer below the carbon cathode block.

In a second embodiment, feldspar powder with some melting temperature lowering compound is applied as a layer below the carbon cathode blocks. Additional Fluoride may be added over time by operating the pot, due to penetration of bath through the carbon cathode material.

In a third embodiment, the barrier material comprises a powder mix of fluoride and nepheline applied as a layer below the cathode.

In a fourth embodiment, nepheline powder with some melting temperature lowering compound is applied as a layer below the cathode. Additional Fluoride may be added over time by operating the pot, due to penetration of fluoride through the cathode material.

Alternatively, the powder in the embodiments above may be substituted by pre-shaped bricks, or a combination of bricks and powder may be applied. The mixed material may also be installed as a slurry.

The minerals applied in accordance with the invention can be either natural or synthetic or a mix of same.

A powder containing both minerals and fluoride components from re-used lining materials (spent pot lining) can also be applied.

The thickness of the barrier layer is 1-300 mm, preferably 50-100 mm, but thinner and thicker layers are also possible.

The invention claimed is:

1. A method for providing a cathode lining barrier layer in a Hall-Héroult electrolysis cell for production of aluminum, wherein the cell comprises an electrolytic bath having components of NaF, $AlF_3$, and $Na_3AlF_6$ in addition to other components, wherein the cathode lining comprises a cathode panel of cathode blocks supported by at least one layer of a refractory material, and wherein during lining of the pot, a mixed material that comprises a mixture of mineral(s) and a chemical compound(s) that effectively lowers the melting temperature of the mineral(s) is arranged between the at least one layer of refractory material and the cathode blocks, wherein the mixture of mineral(s) comprises sodium feldspar and/or nepheline syenite, and wherein the chemical compound(s) comprise fluorides, where during start-up of the cell and as a certain temperature is achieved in the mixed material, and further before penetration of the bath, the mixed material forms a viscous liquid, and where the viscous liquid has high viscosity, and a density higher than that of the bath components eligible to penetrate the cathode blocks and forms a barrier that is effectively immiscible with the penetrating bath components.

2. The method according to claim 1, wherein the minerals of the mixed material comprise sodium feldspar.

3. The method according to claim 1, wherein the minerals of the mixed material comprise nepheline syenite.

4. The method according to claim 1, wherein the mixed material comprises $2^{nd}$ cut spent pot lining having mineral components and fluoride.

5. The method according to claim 1, wherein the mixed material can be in the state of a powder material, as pre-shaped bricks or a slurry.

6. The method according to claim 1, wherein the fluoride concentration is >0-30% wt of the mixed material.

7. The method according to claim 1, wherein the fluoride concentration is 10-20% wt of the mixed material.

8. The method according to claim 1, wherein the fluoride concentration is 15% wt of the mixed material.

9. The method according to claim 1, wherein the barrier layer has a thickness of 1-300 mm.

10. The method according to claim 1, wherein the barrier layer has a thickness of 50-100 mm.

11. The method according to claim 1, wherein the viscosity of the material can be tuned by additives comprising $SiO_2$.

12. A material to be used as a cathode lining barrier layer in a Hall-Héroult electrolysis cell for aluminiuim production, wherein, the material comprises a mixture of mineral(s) comprising sodium feldspar and/or nepheline syenite and a chemical compound(s) comprising fluorides that effectively lower the melting point of the mineral(s) and forms a viscous liquid at a predefined lower temperature than the melting temperature of the mineral(s) where the viscous liquid has a density higher than bath components eligible for penetration through the cathode, thus preventing such penetration.

13. The material according to claim 12, wherein the lower limit for the melting temperature of the material is in the range 600-970° C.

14. The material according to claim 12, wherein the material comprises a homogenous mixture of minerals and fluoride compounds.

* * * * *